US011260276B2

(12) United States Patent
Motokawa

(10) Patent No.: US 11,260,276 B2
(45) Date of Patent: Mar. 1, 2022

(54) GOLF CLUB HEAD

(71) Applicant: Sumitomo Rubber Industries, Ltd., Kobe (JP)

(72) Inventor: Yuki Motokawa, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 17/178,255

(22) Filed: Feb. 18, 2021

(65) Prior Publication Data

US 2021/0268342 A1 Sep. 2, 2021

(30) Foreign Application Priority Data

Feb. 28, 2020 (JP) ..... JP2020-034135

(51) Int. Cl.
*A63B 53/04* (2015.01)

(52) U.S. Cl.
CPC ..... *A63B 53/047* (2013.01); *A63B 53/0408* (2020.08); *A63B 2209/00* (2013.01)

(58) Field of Classification Search
CPC ..... A63B 53/047; A63B 53/0408; A63B 2209/00
USPC ..... 473/324–350, 287–292
See application file for complete search history.

(56) References Cited

U.S. PATENT DOCUMENTS 5,330,187 A * 7/1994 Schmidt ..... A63B 53/04 473/291
5,683,310 A * 11/1997 Chen ..... A63B 53/047 473/349
6,506,129 B2 * 1/2003 Chen ..... A63B 53/04 473/329
6,648,774 B1 * 11/2003 Lee ..... A63B 53/0466 473/342
7,121,958 B2 * 10/2006 Cheng ..... A63B 53/047 473/345
7,431,665 B2 * 10/2008 Sugimoto ..... A63B 60/00 473/342
7,578,754 B2 * 8/2009 Nakamura ..... A63B 53/047 473/342
7,604,549 B2 * 10/2009 Sugimoto ..... A63B 53/047 473/342
7,789,772 B2 * 9/2010 Sukman ..... A63B 60/54 473/334
8,475,293 B2 * 7/2013 Morin ..... A63B 53/047 473/329

(Continued)

*Primary Examiner* — Sebastiano Passaniti
(74) *Attorney, Agent, or Firm* — Xsensus LLP

(57) ABSTRACT

A golf club head includes a face member and a body member. The face member includes a peripheral portion that extends toward a back side. The peripheral portion includes a sole-side peripheral portion and a top-side peripheral portion. The face member is formed of a rolled material. An inner surface of the sole-side peripheral portion includes a sole inner surface inclined portion that extends toward a top direction as the sole inner surface inclined portion goes toward a back direction. The inner surface of the sole-side peripheral portion and an inner surface of the top-side peripheral portion are formed such that a first distance between them increases toward the back direction. An outer surface of the top-side peripheral portion is formed such that a second distance between the outer surface and the inner surface of the top-side peripheral portion increases toward a face direction.

20 Claims, 8 Drawing Sheets

(56) References Cited

U.S. PATENT DOCUMENTS 8,672,772 B2 * 3/2014 Jertson ..... A63B 53/0475 473/290
8,801,540 B2 * 8/2014 Hebreo ..... A63B 53/047 473/329
8,876,630 B2 * 11/2014 Takechi ..... A63B 60/02 473/332
9,393,467 B2 * 7/2016 Kitagawa ..... A63B 53/047
9,630,072 B2 * 4/2017 Finn ..... B29C 45/1671
9,782,644 B2 * 10/2017 Dolezel ..... A63B 53/047
10,369,431 B2 * 8/2019 Nakamura ..... A63B 53/047
10,653,929 B2 * 5/2020 Kii ..... A63B 60/52
10,758,791 B2 * 9/2020 Norimura ..... A63B 53/047
2004/0083596 A1 * 5/2004 Willett ..... A63B 53/0466 29/557
2004/0185960 A1 * 9/2004 Chen ..... A63B 53/047 473/342
2006/0128496 A1 * 6/2006 Weber ..... C22C 38/50 473/324
2006/0281582 A1 * 12/2006 Sugimoto ..... A63B 53/047 473/346
2006/0287131 A1 * 12/2006 Hirano ..... A63B 60/00 473/345
2006/0293119 A1 * 12/2006 Hou ..... A63B 53/047 473/342
2007/0232410 A1 * 10/2007 Chu ..... A63B 53/04 473/345
2007/0270236 A1 * 11/2007 Hirano ..... A63B 53/04 473/345
2008/0153626 A1 * 6/2008 Matsunaga ..... A63B 53/047 473/350
2008/0287216 A1 * 11/2008 Nakamura ..... A63B 53/047 473/350
2015/0375068 A1 12/2015 Mizutani

* cited by examiner

GOLF CLUB HEAD

CROSS REFERENCE TO RELATED APPLICATION

The present application claims priority to Japanese Patent Application No. 2020-34135 filed on Feb. 28, 2020. The entire contents of this Japanese Patent Application are hereby incorporated by reference.

BACKGROUND

Technical Field

The present disclosure relates to a golf club head.

Description of the Related Art

JP2016-26557A (US2015/0375068A1) discloses a golf club head that includes a face member having a cup face structure. This face structure contributes to improvement in rebound performance.

SUMMARY

From the viewpoint of rebound performance, it may be preferable to use a high-strength face member. However, high-strength materials may have limitations on their forming methods.

The present disclosure provides a golf club head that can be formed using a high-strength material and has a structure advantageous for rebound performance, among other advantages.

In one aspect, the present disclosure provides a golf club head including a face member and a body member joined to the face member. The face member includes a face portion that forms a hitting face and a peripheral portion that extends toward a back side from a periphery of the face portion. The peripheral portion includes a sole-side peripheral portion that extends toward the back side from the periphery of the face portion on a sole side and a top-side peripheral portion that extends toward the back side from the periphery of the face portion on a top side. The face member is formed of a rolled material. An inner surface of the sole-side peripheral portion includes a sole inner surface inclined portion that extends to reach a back end of the sole-side peripheral portion and that extends toward a top direction as the sole inner surface inclined portion goes toward a back direction. The inner surface of the sole-side peripheral portion and an inner surface of the top-side peripheral portion are formed such that, in a cross section perpendicular to a toe-heel direction, a first distance between the inner surfaces increases toward the back direction. An outer surface of the top-side peripheral portion is formed such that, in the cross section perpendicular to the toe-heel direction, a second distance between the outer surface and the inner surface of the top-side peripheral portion increases toward a face direction.

DESCRIPTION OF THE PREFERRED EMBODIMENTS

The following terms are defined in the present disclosure.

[Toe-Heel Direction]

Figure 7:
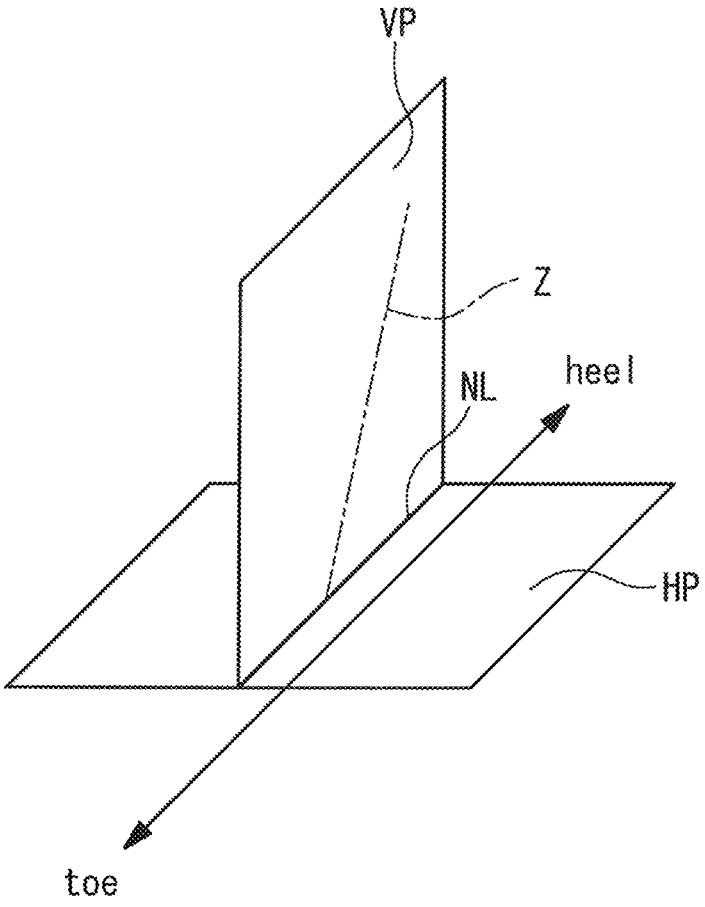
FIG. 7 is a conceptual diagram for illustrating a toe-heel direction.

When a hitting face is a flat surface, the extending direction of a longest face line(s) is defined as a toe-heel direction. When the hitting face is a curved surface, the toe-heel direction is defined as follows. With reference to FIG. 7, in a head that is in a reference state where the head is placed at a predetermined lie angle and a predetermined real loft angle on a horizontal plane HP, a vertical plane VP that is perpendicular to the horizontal plane HP and includes a shaft axis line Z of the head is determined. A direction in which an intersection line NL between the vertical plane VP and the horizontal plane HP extends is defined as the toe-heel direction. The predetermined lie angle and the predetermined real loft angle are shown in product catalogues, for example. The shaft axis line Z usually coincides with the center line of a hosel hole.

[Top-Sole Direction, Top Direction, and Sole Direction]

When the hitting face is a flat surface, a direction that is parallel to the hitting face and perpendicular to the toe-heel direction is defined as a top-sole direction. When the hitting face is a curved surface, a direction that is parallel to a plane tangent to the hitting face at a face center and perpendicular to the toe-heel direction is defined as the top-sole direction. A direction toward a top surface from a sole in this top-sole direction is defined as a top direction. A direction toward the sole from the top surface in this top-sole direction is defined as a sole direction. The top direction and the sole direction are opposite directions to each other.

[Face-Back Direction, Face Direction, and Back Direction]

When the hitting face is a flat surface, a direction perpendicular to the hitting face is defined as a face-back direction. When the hitting face is a curved surface, the direction of a line normal to the hitting face at the face center is defined as the face-back direction. In this face-back direction, a direction toward the hitting face from the back side of the head is defined as a face direction. In the face-back direction, a direction toward the back side of the head from the hitting face is defined as a back direction. The face direction and the back direction are opposite directions to each other.

[Face Center]

When the hitting face is a flat surface, a position that is located at the midpoint of the length of the hitting face in the top-sole direction on the midpoint of the longest face line(s) in the toe-heel direction is defined as the face center. When the hitting face is a curved surface, the geometric center of the hitting face in a plan view is defined as the face center.

Embodiments of the present disclosure will be described in detail below with reference to the drawings as necessary.

Figure 1:
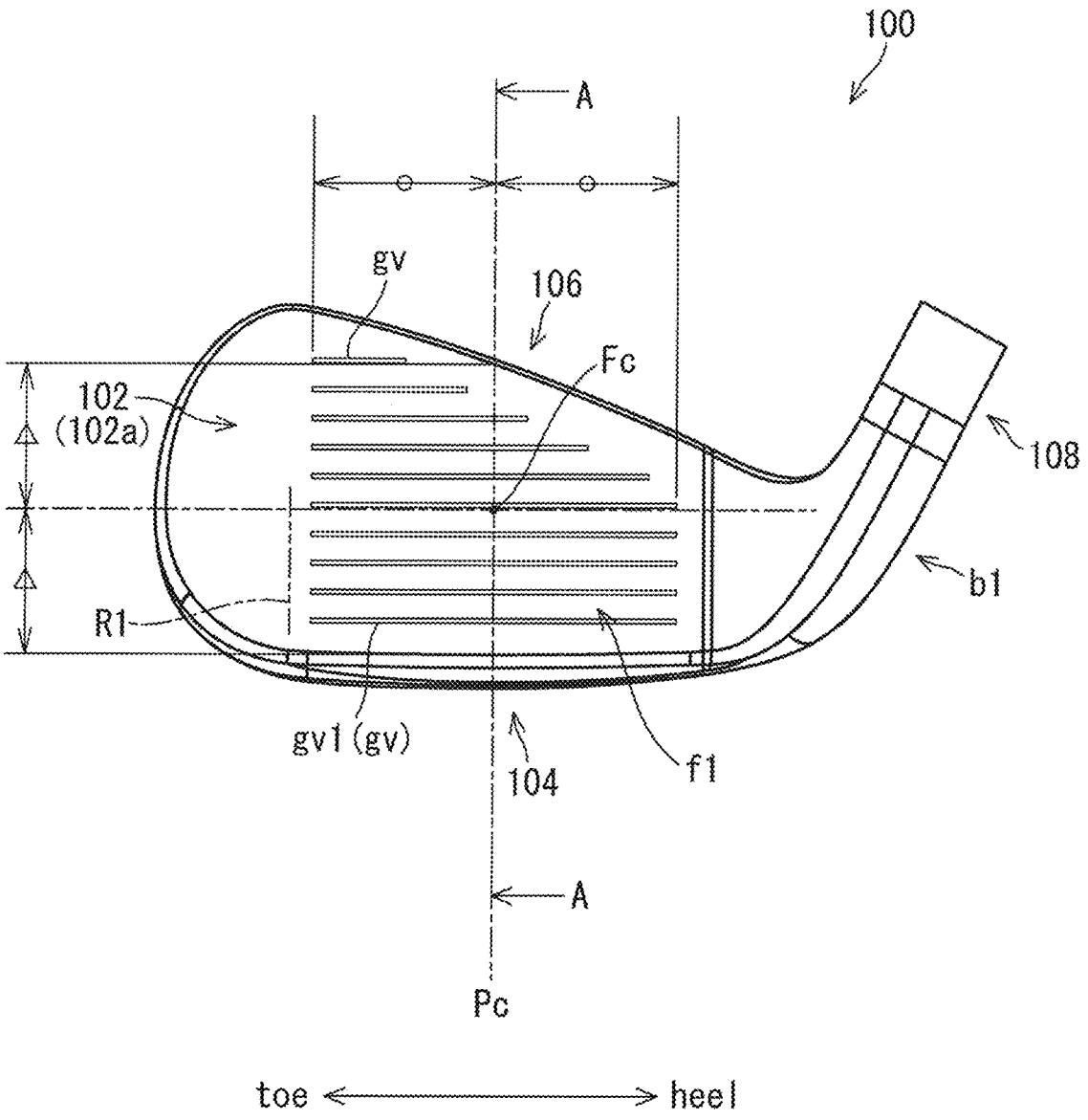
FIG. 1 is a front view of a golf club head according to a first embodiment.
Figure 2:
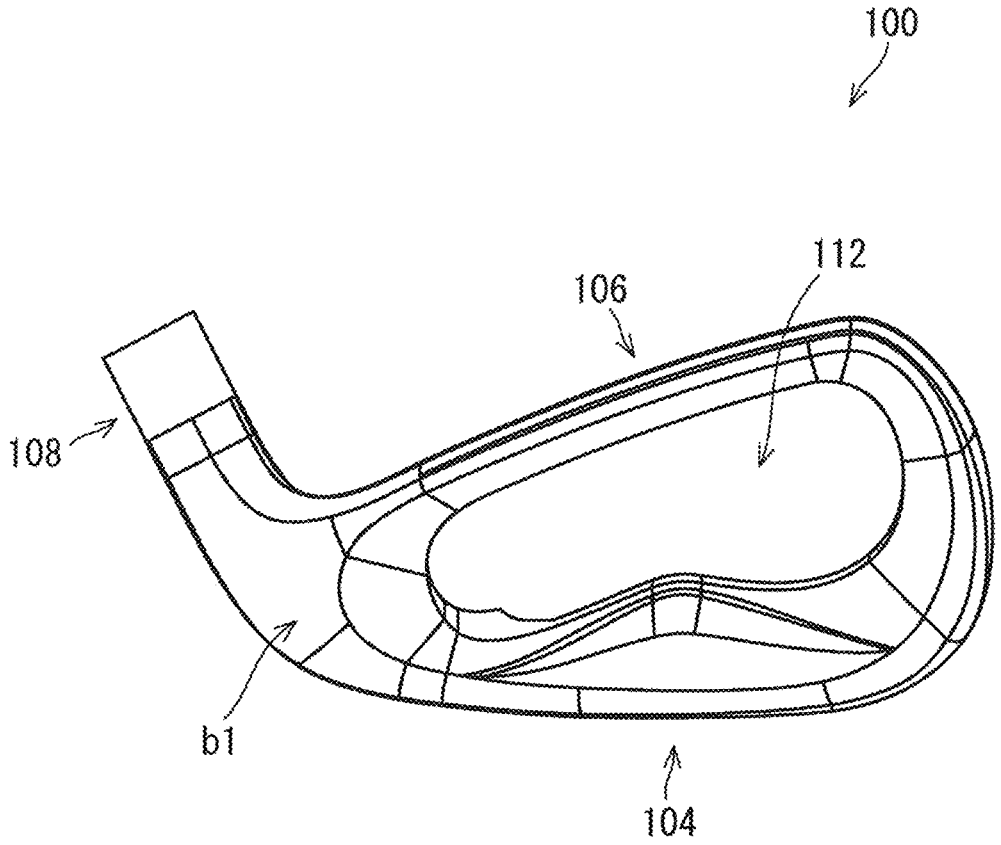
FIG. 2 is a back view of the head shown in FIG. 1.
Figure 3:
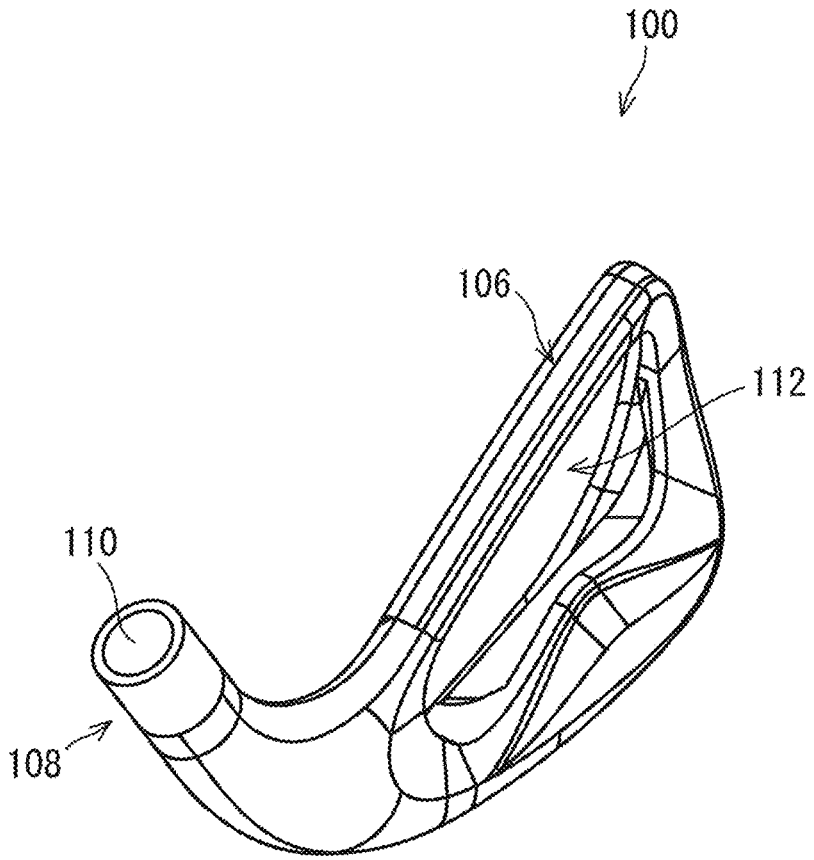
FIG. 3 is a perspective view of the head shown in FIG. 1.

FIG. 1 is a front view of a golf club head 100 according to the first embodiment. FIG. 2 is a back view of the head 100. FIG. 3 is a perspective view of the head 100.

The head 100 includes a face portion 102, a sole portion 104, a top surface 106, and a hosel 108. The face portion 102 includes a hitting face 102*a* and a back surface 102*b*. The hitting face 102*a* is a front surface of the face portion 102. The back surface 102*b* is a rear surface of the face portion 102. When a ball is hit with a golf club, the hitting face 102*a* comes into contact with the ball. The sole portion 104 includes a sole surface 104*a*. The sole surface 104*a* is an outer surface of the sole portion 104. The hosel 108 includes a hosel hole 110. A shaft is attached to the hosel hole 110.

The hitting face 102*a* includes a plurality of face lines gv. The plurality of face lines gv include longest face lines gv1. The hitting face 102*a* has a center point Fc. The center point of the hitting face 102*a* is also referred to as a "face center". The definition of the face center Fc is as described above.

The hitting face 102*a* is a flat surface. Although the hitting face 102*a* has the face lines gv, the hitting face 102*a* is flat if these face lines gv are not taken into account. The back surface 102*b* is also a flat surface. The back surface 102*b* is parallel to the hitting face 102*a*. In the cross-sectional view of FIG. 4, the face lines gv are omitted.

The head 100 is an iron-type golf club head. As shown in FIGS. 2 and 3, the head 100 includes a back cavity 112. The head 100 is a cavity back iron.

The head 100 need not necessarily be an iron-type head. The head 100 may be a wood-type head, a utility-type head, or a putter-type head. The hitting face 102*a* may be a flat surface or a curved surface. The head 100 is preferably an iron-type head, as described below.

Figure 4:
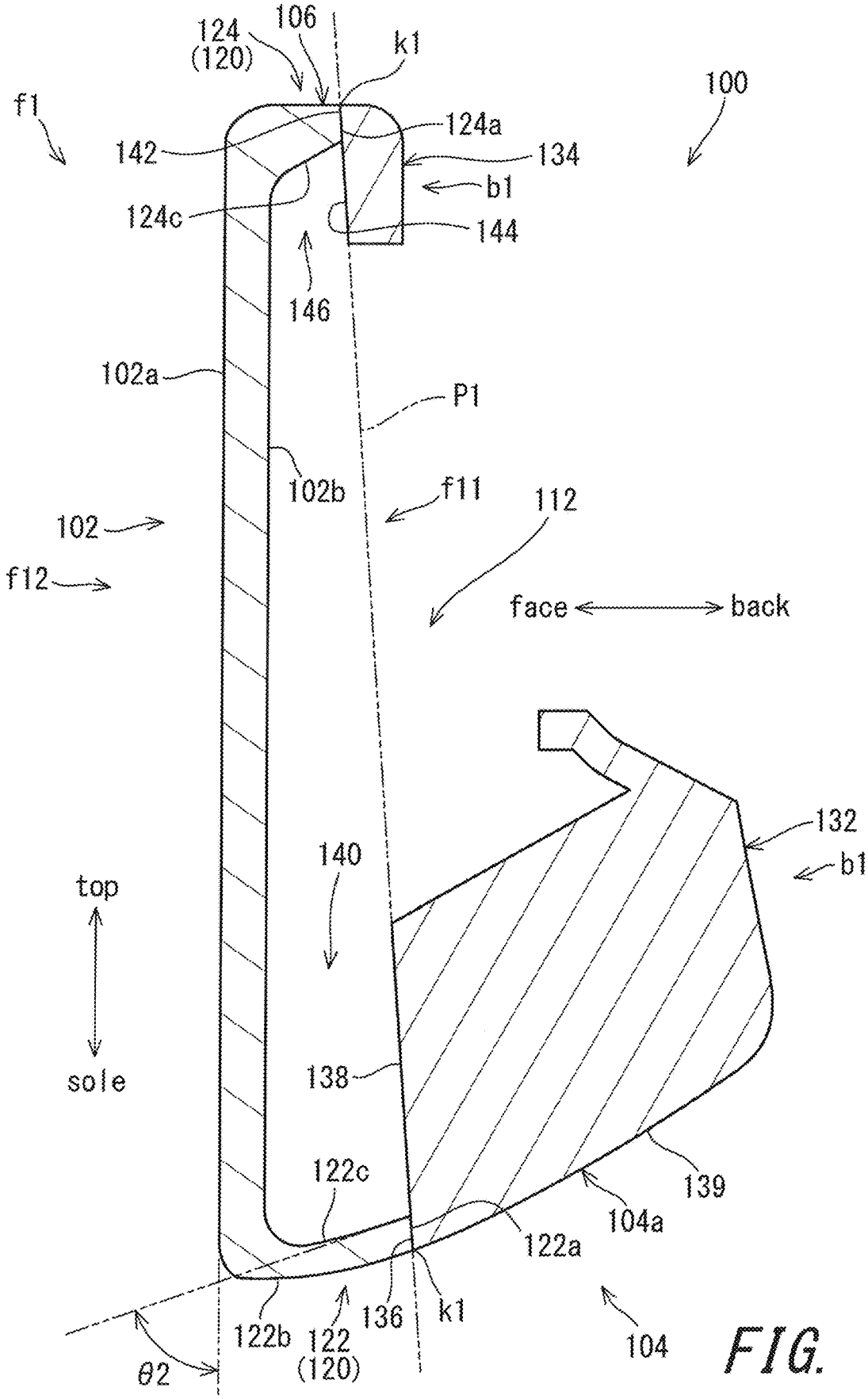
FIG. 4 is a cross-sectional view taken along line A-A in FIG. 1 and in which a hitting face extends vertically.

FIG. 4 is a cross-sectional view taken along line A-A in FIG. 1. In FIG. 4, the hitting face 102*a* extends vertically for ease of understanding. FIG. 4 shows a cross section perpendicular to the toe-heel direction.

The head 100 is constituted by a plurality of members. The head 100 includes a body member b1 and a face member f1. The face member f1 is joined to the body member b1. The body member b1 is integrally formed as a single-piece member. The body member b1 may be constituted by a plurality of members. The face member f1 is integrally formed as a single-piece member.

The face member f1 includes an inner surface f11 and an outer surface f12. The inner surface f11 includes the back surface 102*b* and an inner surface of a peripheral portion 120 (to be described below). The outer surface f12 includes the hitting face 102*a* and an outer surface of the peripheral portion 120.

A boundary k1 between the face member f1 and the body member b1 is on the sole surface 104*a*. The boundary k1 is also on the top surface 106.

The face member f1 includes the face portion 102. The face member f1 includes the entirety of the face portion 102. The face member f1 constitutes the entirety of the hitting face 102*a*. The face member f1 constitutes the entirety of the back surface 102*b*. The face member f1 constitutes a part of the top surface 106. The face member f1 constitutes a hitting face 102*a*-side portion of the top surface 106. The face member f1 constitutes a part of the sole surface 104*a*. The face member f1 constitutes a hitting face 102*a*-side portion of the sole surface 104*a*. The face member f1 constitutes a part of the sole portion 104. The face member f1 constitutes a hitting face 102*a*-side portion of the sole portion 104.

The face member f1 includes: the face portion 102 constituting the hitting face 102*a*; and the peripheral portion 120 extending toward the back side from a periphery of the face portion 102. The peripheral portion 120 includes a sole-side peripheral portion 122 that extends toward the back side from the periphery of the face portion 102 on the sole side and a top-side peripheral portion 124 that extends toward the back side from the periphery of the face portion 102 on the top side.

The peripheral portion 120 does not include a toe-side peripheral portion that extends toward the back side from the periphery of the face portion 102 on the toe side. The peripheral portion 120 may include the toe-side peripheral portion. The peripheral portion 120 does not include a heel-side peripheral portion that extends toward the back side from the periphery of the face portion 102 on the heel side. The peripheral portion 120 may include the heel-side peripheral portion. From the viewpoint of the formability of the face member f1, the peripheral portion 120 preferably does not include either the toe-side peripheral portion or the heel-side peripheral portion.

The body member b1 includes the hosel 108. The body member b1 includes the entirety of the hosel 108. The body member b1 further includes a sole-side portion 132 and a top-side portion 134.

The sole-side portion 132 includes a sole-side joint portion 136 that is joined to the sole-side peripheral portion 122 and a sole-side facing surface 138 that faces the back surface 102*b*. A space 140 is formed between the back surface 102*b* and the sole-side facing surface 138. The space 140 constitutes a part of a space formed by the back cavity 112. The sole-side joint portion 136 is a flat surface. The sole-side facing surface 138 is a flat surface. The sole-side joint surface 136 and the sole-side facing surface 138 are coplanar with each other. A lower surface 139 of the sole-side portion 132 constitutes a part of the sole surface 104*a*. The lower surface 139 constitutes a portion of the sole surface 104*a* on the back side with respect to the boundary k1.

The top-side portion 134 includes a top-side joint portion 142 that is joined to the top-side peripheral portion 124 and a top-side facing surface 144 that faces the back surface 102*b*. A space 146 is formed between the back surface 102*b* and the top-side facing surface 144. The space 146 constitutes a part of the space formed by the back cavity 112. The top-side joint portion 142 is a flat surface. The top-side facing surface 144 is a flat surface. The top-side joint portion 142 and the top-side facing surface 144 are coplanar with each other.

The sole-side joint portion 138 and the top-side facing surface 144 are on a same plane P1. A back end surface 124*a* of the top-side peripheral portion 124 and a back end surface 122*a* of the sole-side peripheral portion 122 are on the same plane P1. The sole-side joint portion 136 and the top-side joint portion 142 are on the same plane P1. The plane P1 is inclined so as to be closer to the hitting face 102*a* toward the top direction. When the back end surface 124*a* and the back end surface 122*a* are on the same plane P1, processing of these back surfaces can be performed easily. From the viewpoint of improving the joining accuracy between the face member f1 and the body member b1, edge portions of the face member f1, including the back end surfaces 124*a* and 122*a*, are preferably subjected to NC processing. Since the surfaces to be processed are on the same plane P1, height adjustment of a processing machine during processing is not necessary, which also contributes to the improvement of the joining accuracy between the face member f1 and the body member b1.

The face member f1 is joined to the body member b1. This joining is achieved by welding. The back end surface 122*a* of the sole-side peripheral portion 122 is joined to the sole-side joint portion 136 of the body member b1. The back end surface 124*a* of the top-side peripheral portion 124 is joined to the top-side joint portion 142 of the body member b1.

Figure 5:
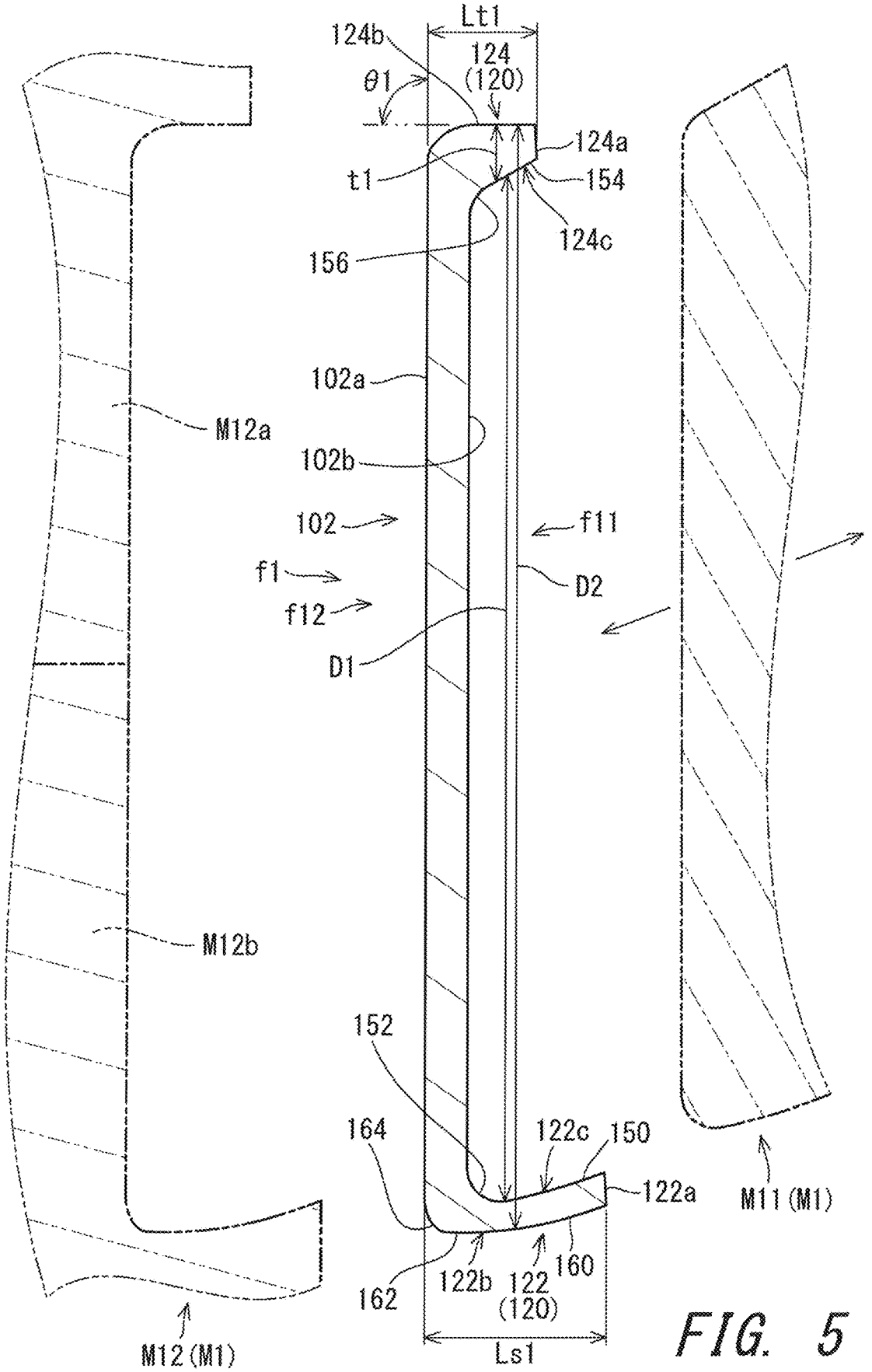
FIG. 5 is a cross-sectional view of a face member shown in FIG. 4.

FIG. 5 is a cross-sectional view of the face member f1. FIG. 5 shows only the face member f1 isolated from FIG. 4. FIG. 5 shows a cross section perpendicular to the toe-heel direction.

The sole-side peripheral portion 122 includes an outer surface 122*b* and an inner surface 122*c*. The outer surface 122*b* constitutes a part of the sole surface 104*a*. The outer surface 122*b* constitutes a portion of the sole surface 104*a* on the face side with respect to the boundary k1. The inner surface 122*c* faces the space 140 (see FIG. 4).

The top-side peripheral portion 124 includes an outer surface 124*b* and an inner surface 124*c*. The outer surface 124*b* constitutes a part of the top surface 106. The outer surface 124*b* constitutes a portion of the top surface 106 on the face side with respect to the boundary k1. The inner surface 124*c* faces the space 146 (see FIG. 4).

In the present embodiment, the entirety of the cross-sectional contour line of the inner surface 122*c* is curved. This curved line is curved so as to project toward the outer surface 122*b*. The cross-sectional contour line of the inner surface 122*c* may include a straight portion. Alternatively, the entirety of the cross-sectional contour line of the inner surface 122*c* may be straight.

In the present embodiment, the cross-sectional contour line of the inner surface 124*c* includes a straight portion. The entirety of the cross-sectional contour line of the inner surface 124*c* may be curved. Alternatively, the entirety of the cross-sectional contour line of the inner surface 124*c* may be straight.

The inner surface 122*c* of the sole-side peripheral portion 122 includes a sole inner surface inclined portion 150 that extends toward the top direction as it goes toward the back direction. The sole inner surface inclined portion 150 extends to reach the back end (back end surface 122*a*) of the sole-side peripheral portion 122. In the cross section perpendicular to the toe-heel direction, an angle θ2 formed between the sole inner surface inclined portion 150 and the hitting face 102*a* is smaller than 90 degrees (see FIG. 4). In the present embodiment, since the sole inner surface inclined portion 150 is a curved surface, the angle θ2 is an angle formed between the hitting face 102*a* and a tangent line to the cross-sectional contour line of the sole inner surface inclined portion 150 at each point thereon.

The inner surface 122*c* includes a transition portion 152 that connects the sole inner surface inclined portion 150 and the back surface 102*b*. The transition portion 152 is rounded (curved). The transition portion 152 constitutes a corner portion where the back surface 102*b* and the inner surface 122*c* intersect with each other. The inner surface 122*c* is constituted by the sole inner surface inclined portion 150 and the transition portion 152.

The inner surface 124*c* of the top-side peripheral portion 124 includes a top inner surface inclined portion 154 that extends toward the top direction as it goes toward the back direction. The top inner surface inclined portion 154 extends to reach the back end (back end surface 124*a*) of the top-side peripheral portion 124.

The inner surface 124*c* includes a transition portion 156 that connects the top inner surface inclined portion 154 and the back surface 102*b*. The transition portion 156 is rounded (curved). The transition portion 156 constitutes a corner portion where the back surface 102*b* and the inner surface 124*c* intersect with each other. The inner surface 124*c* is constituted by the top inner surface inclined portion 154 and the transition portion 156.

The outer surface 122*b* of the sole-side peripheral portion 122 includes a sole outer surface inclined portion 160 that extends toward the top direction as it goes toward the back direction. The sole outer surface inclined portion 160 extends to reach the back end (back end surface 122*a*) of the sole-side peripheral portion 122.

The outer surface 122*b* includes a transition portion 162 that extends toward the face side from the sole outer surface inclined portion 160. The transition portion 162 is connected to a sole-side edge portion 164 formed on the lower side of the hitting face 102*a*. The sole-side edge portion 164 is rounded (curved).

The outer surface 124*b* of the top-side peripheral portion 124 extends in such a manner that a distance t1 between the outer surface 124*b* and the inner surface 124*c* decreases toward the back direction. In other words, the outer surface 124*b* extends in such a manner that the distance t1 between the outer surface 124*b* and the inner surface 124*c* increases toward the face direction. That is, the outer surface 124*b* is formed in such a manner that, in a cross section perpendicular to the toe-heel direction, the distance t1 from the inner surface 124*c* increases toward the face direction. The distance t1 is measured in the top-sole direction. The face-side end of the outer surface 124*b* is joined to the periphery of the face portion 102.

In the present embodiment, the cross-sectional contour line of the outer surface 124*b* is straight. A part or the entirety of the cross-sectional contour line of the outer surface 124*b* may be curved. In the cross section perpendicular to the toe-heel direction (FIG. 5), an angle θ1 formed between the outer surface 124*b* and the hitting face 102*a* is substantially 90° (90°±5°).

A double-headed arrow D1 in FIG. 5 indicates a distance between the inner surface 122*c* and the inner surface 124*c*. The distance D1 increases toward the back direction. In other words, the inner surface 122*c* and the inner surface 124*c* are formed in such a manner that, in a cross section perpendicular to the toe-heel direction, the distance D1 between them increases toward the back direction. The distance D1 is measured in the top-sole direction.

The face member f1 includes the sole inner surface inclined portion 150 that extends toward the top direction as it goes toward the back direction. However, the inner surface 124*c* is formed in such a manner that the distance D1 increases toward the back direction. This configuration can provide a draft angle for a male mold used for forming the inner surface f11 of the face member f1. The face member f1 can be formed by pressing or forging.

The configuration in which the distance t1 increases toward the face direction can enlarge the hitting face 102*a* upward. As a result, the area of the hitting face 102*a* can be increased. The hitting face 102*a* with a large area can afford a golfer a feeling of security.

With the configuration in which the distance t1 increases toward the face direction, the angle θ1 formed by the outer surface 124*b* of the top-side peripheral portion 124 and the hitting face 102*a* can be close to 90 degrees. In an iron-type head having a traditional shape, the angle θ1 is close to 90 degrees. The configuration in which the distance t1 increases toward the face direction can enable the top blade to have a shape similar to that of a traditional top blade, whereby uneasiness felt by a golfer can be reduced.

[Material of Face Member]

The face member f1 is formed of a rolled material. Rolled materials have few defects and high strength. Preferably, the rolled material has a plate shape.

The rolled material is made of, for example, an iron-based alloy, a titanium alloy, pure titanium, an aluminum alloy, a magnesium alloy, or a tungsten-nickel alloy.

The iron-based alloy means an alloy in which the content of iron (Fe) is the highest in terms of mass ratio. Examples of the iron-based alloy include iron alloys and alloy steel. The iron-based alloy may be, for example, steel, stainless steel, or maraging steel. An iron-based alloy that can be used suitably as the rolled material for the face member is, for example, stainless steel. The stainless steel is preferably, for example, SUS 630 or HT1770M, and more preferably HT1770M.

Examples of a titanium alloy that can be used suitably as the rolled material for the face member include Ti-6Al-4V, TIX 51AF (Ti-5.5Al-1Fe), Ti-15V-3Cr-3Sn-3Al, DAT55G (Ti-15V-6Cr-4Al), SP700 (Ti-4.5Al-3V-2Fe-2Mo), T9S, Ti-15Mo-5Zr-3Al, Ti-15Mo-3Al, and Ti-6Al-2Sn-2Zr-2Cr-2Mo-0.25Si.

When the rolled material is made of a titanium alloy, the forming step of the rolled material is preferably performed by cold pressing. Since cold pressing does not involve heating, transformation of titanium can be suppressed. When the rolled material is made of an iron-based alloy, the forming step of the rolled material can be preferably performed by hot pressing from the viewpoint of formability.

The rolled material may be a unidirectional rolled material obtained by rolling a material in one direction. Unidirectional rolled materials can have anisotropy. The length of the face member f1 in the toe-heel direction is greater than the length of the face member f1 in the top-sole direction. Accordingly, when the rolled material does not have anisotropy, the face member f1 may exhibit a large amount of flexure in its cross section taken along the toe-heel direction. From the viewpoint of effectively improving the strength against this flexure, the direction perpendicular to a rolling direction can be preferably close to the toe-heel direction. Moreover, unidirectional rolled materials exhibit a small elastic modulus in flexure deformation of a cross section taken along the rolling direction. Accordingly, also from the viewpoint of allowing the face member f1 having a shorter length in the top-sole direction to bend easily, the direction perpendicular to the rolling direction can be preferably close to the toe-heel direction. From these viewpoints, an angle formed by the rolling direction and the top-sole direction is preferably less than or equal to 25 degrees, more preferably less than or equal to 20 degrees, and still more preferably less than or equal to 15 degrees. This angle may be 0 degree. The rolling direction is a direction in which a material is conveyed during a rolling process. In the present embodiment, the rolling direction R1 is parallel to the top-sole direction, and the above-described angle is 0 degree (see FIG. 1).

From the viewpoint of the strength of the face member f1, the rolled material preferably can have a high tensile strength. By setting the tensile strength high, the thickness of the face member f1 can be reduced. As a result, the weight of the face member f1 can be reduced. The face member f1 having the reduced weight can allow the body member b1 to have an increased weight, which can increase the degrees of freedom in designing the body member b1.

From the viewpoint of reducing the thickness of the face member f1, when the rolled material is an iron-based alloy, the tensile strength of the rolled material is preferably greater than or equal to 1200 MPa and more preferably greater than or equal to 1300 MPa. From the viewpoint of the formability and also from the viewpoint of the types of iron-based alloy available as the rolled material, this tensile strength is preferably less than or equal to 2000 MPa and more preferably less than or equal to 1900 MPa.

From the viewpoint of reducing the thickness of the face member f1, when the rolled material is a titanium alloy, the tensile strength of the rolled material is preferably greater than or equal to 800 MPa and more preferably greater than or equal to 900 MPa. Considering the types of titanium alloy available as the rolled material, the tensile strength is preferably less than or equal to 1500 MPa and more preferably less than or equal to 1400 MPa.

The tensile strength is measured according to tensile testing specified in JIS Z 2241. In this tensile testing, a 13B test piece is used as a test piece.

From the viewpoint of reducing the weight of the face member f1, when the rolled material is an iron-based alloy, the face portion 102 preferably has an average thickness of less than or equal to 2.2 mm, more preferably less than or equal to 2.1 mm, and still more preferably less than or equal to 2.0 mm. From the viewpoint of the strength of the face member f1, when the rolled material is an iron-based alloy, the face portion 102 preferably has an average thickness of greater than or equal to 1.5 mm, more preferably greater than or equal to 1.6 mm, and still more preferably greater than or equal to 1.7 mm. The average thickness is an area-weighted average thickness.

From the viewpoint of reducing the weight of the face member f1, when the rolled material is a titanium alloy, the face portion 102 preferably has an average thickness of less than or equal to 2.5 mm, more preferably less than or equal to 2.4 mm, and still more preferably less than or equal to 2.3 mm. From the viewpoint of the strength of the face member f1, when the rolled material is a titanium alloy, the face portion 102 preferably has an average thickness of greater than or equal to 1.8 mm, more preferably greater than or equal to 1.9 mm, and still more preferably greater than or equal to 2.0 mm.

[Production Method]

The face member f1 is produced by pressing or forging. From the viewpoints of the thickness accuracy of the rolled material and a feeling when hitting a ball, the face member f1 can be preferably produced by pressing. In pressing, the uniform structure of the rolled material can likely be maintained, which can result in an improved feeling when hitting a ball. As described above, pressing may be cold pressing or hot pressing, for example.

The method for producing the face member f1 includes the following steps, for example. These steps are preferably performed by pressing.

(Step 1) a step of cutting a rolled material into a shape corresponding to the shape of the face member f1.

(Step 2) a face member forming step of forming the face member f1 with a mold from the rolled material that has been cut into the predetermined shape.

The above-described face member forming step is performed by forging or pressing. It is preferable to perform forging or pressing a plurality of times. The number of times the forging or pressing is performed is preferably set to greater than or equal to two times and less than or equal to four times. As described above, the face member forming step is performed more preferably by pressing.

The method for producing the face member f1 preferably further includes the following step.

(Step 3) a thickness adjustment step of adjusting the thickness distribution of the rolled material by NC processing, the thickness adjustment step being performed prior to the face member forming step.

The method for producing a head including the thus-produced face member f1 includes the following steps, in addition to the above-described steps of producing the face member f1.

(Step 4) a step of forming the body member b1.

(Step 5) a step of joining the face member f1 to the body member b1.

Examples of the method for forming the body member b1 include casting, forging, and pressing. From the viewpoint of the degrees of freedom in the shape obtained through forming, the body member b1 is preferably formed by casting. The body member b1 may be formed by combining a plurality of members. Examples of the method for joining the face member f1 to the body member b1 include welding, brazing, adhesive bonding, press-fitting, and screwing. Of these, welding is preferable from the viewpoint of joining strength.

In the thickness adjustment step, it is preferable to reduce the thickness at a position where an excessively large thickness (excess thickness) is generated by bending during the face member forming step. In particular, a portion to be processed into the transition portion 152 can be subjected to large bending deformation in the face member forming step (see FIG. 5). In the thickness adjustment step, it is preferable to reduce the thickness of the portion to be processed into the transition portion 152. Further, in the thickness adjustment step, it is preferable to make a portion to be processed into the sole-side peripheral portion 122 thinner than a portion to be processed into the face portion 102. Still further, in the thickness adjustment step, it is preferable to adjust the thickness of a portion to be processed into the top-side peripheral portion 124 such that the distance t1 in the face member f1 after being formed increases toward the face direction. That is, in the thickness adjustment step, it is preferable to form a portion whose thickness varies in the portion to be processed into the top-side peripheral portion 124 such that the distance t1 in the face member f1 after being formed increases toward the face direction.

The thickness adjustment step may be performed prior to the step 1 or after the step 1. The step 1 may be performed by NC processing. NC is an abbreviation of "numerical control". More preferable NC processing is CNC processing. CNC is an abbreviation of "computerized numerical control".

By performing the thickness adjustment step prior to the face member forming step, the face member forming step can be performed easily. This advantageous effect can be particularly prominent when the face member forming step is performed by pressing. In the present embodiment, the sole-side peripheral portion 122 can have a large bending angle. By reducing the thickness of the sole outer surface inclined portion 160 prior to the face member forming step, processing of forming the sole-side peripheral portion 122 by largely bending the rolled material can be performed easily.

In FIG. 5, a conceptual diagram of a cross section of a mold M1 to be used in the face member forming step is indicated with virtual lines. The mold M1 includes a male mold M11 and a female mold M12. The male mold M11 is used to form the inner surface f11 of the face member f1. The inner surface f11 includes the inner surface 122*c*, the back surface 102*b*, and the inner surface 124*c*. The female mold M12 is used to form the outer surface f12 of the face member f1. The outer surface f12 includes the outer surface 122*b*, the hitting face 102*a*, and the outer surface 124*b*.

As described above, in the face member f1, the distance D1 between the inner surface 122*c* and the inner surface 124*c* increases toward the back direction. With this configuration, a draft angle for the male mold M11 can be provided. On the other hand, a draft angle for the female mold M12 may not be provided. The surface formed using the female mold M12 is the outer surface f12 of the face member f1. The outer surface f12 has an undercut shape. The outer surface f12 includes the outer surface 122*b*, the outer surface 124*b*, and the hitting face 102*a*. The distance D2 between the outer surface 124*b* of the top-side peripheral portion 124 and the sole outer surface inclined portion 160 decreases toward the back direction. The distance D2 is measured in the top-sole direction.

The female mold M12 includes a first segment M12*a* and a second segment M12*b*. The female mold M12 can be a segmented mold. Accordingly, the face member f1 can be taken out from the female mold M12 by separating the segments of the female mold M12 even when a draft angle is not provided. It may be difficult to use a segmented mold as the male mold M11 from the viewpoint of its strength. On the other hand, there may be no problem in using a segmented mold as the female mold M12.

In FIG. 5, a double-headed arrow Lt1 indicates the length of the top-side peripheral portion 124. The length Lt1 is measured in the face-back direction. The length Lt1 is measured from the hitting face 102*a*. In FIG. 5, a double-headed arrow Ls1 indicates the length of the sole-side peripheral portion 122. The length Ls1 is measured in the face-back direction. The length Ls1 is measured from the hitting face 102*a*.

The length Ls1 of the sole-side peripheral portion 122 is greater than the length Lt1 of the top-side peripheral portion 124. By increasing the length Ls1, the sole outer surface inclined portion 160 can be made long. This configuration can allow the sole-side peripheral portion 122 to be easily deformed when hitting a ball, whereby the rebound performance in hitting at a lower hit point can be improved.

Hitting at a lower hit point can mean hitting with the hit point being at a lower part of the hitting face 102*a*. In particular, an iron-type head may have many opportunities to hit a ball that is placed directly on turf without being teed up and thus may often perform hitting at a lower hit point. Improvement of the rebound performance in hitting at a lower hit point can enhance, in particular, the performance of an iron-type head. Hitting with the hit point being at a position lower than the face center is referred to as "hitting at a lower hit point".

From the viewpoint of the rebound performance in hitting at a lower hit point, the length Ls1 is preferably greater than or equal to 5 mm, more preferably greater than or equal to 6 mm, and still more preferably greater than or equal to 7 mm. From the viewpoint of the formability of the face member f1, the length Ls1 is preferably less than or equal to 13 mm, more preferably less than or equal to 12 mm, and still more preferably less than or equal to 11 mm.

An excessively small width of the top surface 106 can cause a golfer to feel uneasy when addressing a golf ball. From this viewpoint, the length Lt1 is preferably greater than or equal to 3 mm, more preferably greater than or equal to 4 mm, and still more preferably greater than or equal to 5 mm. When the top surface 106 has an excessively large width, the shape of the head may become dissimilar to a traditional head shape, which may increase uneasiness felt by a golfer. From this viewpoint, the length Lt1 is preferably less than or equal to 11 mm, more preferably less than or equal to 10 mm, and still more preferably less than or equal to 9 mm.

The sole-side peripheral portion 122 has a large bending angle and thus is difficult to form. From the viewpoint of improving the formability of the sole-side peripheral portion 122, the thickness of the sole outer surface inclined portion 160 is preferably less than or equal to 2.0 mm, more preferably less than or equal to 1.8 mm, and still more preferably less than or equal to 1.6 mm. Such a thickness is preferable also from the viewpoint of the rebound performance in hitting at a lower hit point. By using a rolled material, the strength of the sole outer surface inclined portion 160 can be improved, which can allow the sole outer surface inclined portion 160 to be made thinner. From the viewpoint of strength, the thickness of the sole outer surface inclined portion 160 is preferably greater than or equal to 0.8 mm, more preferably greater than or equal to 1.0 mm, and more preferably greater than or equal to 1.2 mm. The thickness is measured in a direction normal to the outer surface 122*b*. This normal direction may vary depending on the position on the outer surface 122*b*.

There is no limitation on the loft angle of the head 100. The loft angle means a real loft angle. In a head with a large loft angle, the sole-side peripheral portion 122 may tend to have a large bending angle. When the loft angle is large, the above-described effect of providing the draft angle utilizing the shape of the inner surface 124*c* can be enhanced. From this viewpoint, the loft angle of the head 100 is preferably greater than or equal to 20 degrees, more preferably greater than or equal to 21 degrees, and still more preferably greater than or equal to 22 degrees. In a head having an excessively large loft angle, the strength required for the face member f1 may be low. Accordingly, in such a head, it may not always be necessary to use a face member formed of a rolled material. From this viewpoint, the loft angle of the head 100 is preferably less than or equal to 45 degrees, more preferably less than or equal to 42 degrees, and still more preferably less than or equal to 39 degrees.

The face member f1 that is formed of a rolled material and includes the sole-side peripheral portion 122 and the top-side peripheral portion 124 can improve the rebound performance. COR at a sweet spot (also referred to as "SS-COR") is preferably greater than or equal to 0.825, more preferably greater than or equal to 0.830, and still more preferably greater than or equal to 0.835. Considering the durability, SS-COR is preferably less than or equal to 0.850, more preferably less than or equal to 0.845, and still more preferably less than or equal to 0.840. The SS-COR is measured at the sweet spot. The sweet spot is an intersection point between the hitting face 102*a* and a straight line that passes through the center of gravity of the head and is perpendicular to the hitting face 102*a* (or a tangent plane thereto). The SS-COR is an average value of ten measured values.

COR means a coefficient of restitution. The COR is measured according to "Interim Procedure for Measuring the Coefficient of Restitution of an Iron Clubhead Relative to a Baseline Plate Revision 1.3 Jan. 1, 2006" specified by the USGA (United States Golf Association).

Figure 8:
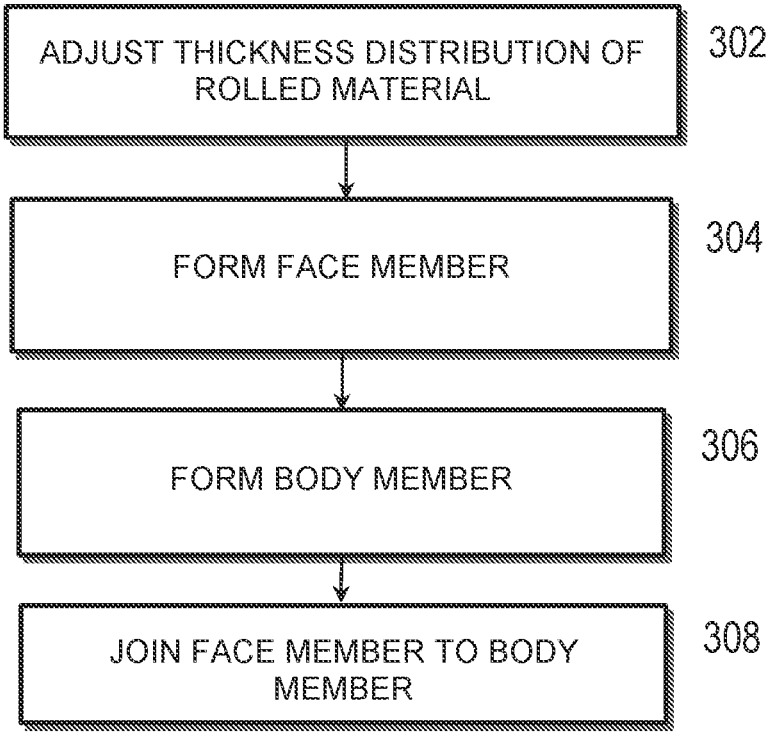
FIG. 8 is a flow chart representing a method according to one or more embodiments of the disclosed subject matter.

FIG. 8 is a flow chart representing a method according to one or more embodiments of the disclosed subject matter. The method can comprise forming a face member according to one or more embodiments of the disclosed subject matter at 304, forming a body member according to one or more embodiments of the disclosed subject matter at 306, and joining the face member to the body member at 308. Optionally, prior to forming the face member at 304 the method can include adjusting a thickness distribution of rolled material from which the face member is to be formed.

EXAMPLES

Examples

A head having the same configuration as the head 100 of the first embodiment was produced. As the material of a face member f1, a rolled material was prepared. As this rolled material, a product with a trade name "HT1770M" manufactured by Nippon Steel Nisshin Co., Ltd. was used. This rolled material is a unidirectional rolled material. First, this rolled material was cut into a predetermined shape corresponding to the shape of the face member. The rolled material was cut in such a manner that the rolling direction was the top-sole direction. Next, the thickness adjustment step of adjusting the thickness distribution of the rolled material was performed by trimming off the back surface side of the rolled material through NC processing. In this thickness adjustment step, the thickness of a portion to be processed into a transition portion 152 was reduced. Further, in this thickness adjustment step, a portion to be processed into a sole-side peripheral portion 122 was made thinner than a portion to be processed into a face portion 102. Also, in the thickness adjustment step, the thickness of a portion to be processed into a top-side peripheral portion 124 was adjusted such that the distance t1 in the face member f1 after being formed increased toward the face direction. Next, the rolled material was subjected to the face member forming step using a mold. The forming was performed by hot pressing. The face member f1 was formed by performing the pressing three times. The press mold included a male mold and female mold, and the female mold was a segmented mold. By separating the segments of the female mold, the formed face member f1 was taken out from the press mold. The body member b1 was produced by casting (lost-wax precision casting). The face member f1 was welded to the body member b1. Further, face lines gv were formed on a hitting face 102*a* by NC processing. Surface finishing was performed by polishing. Thus, the head according to the Example was obtained. The thickness of the face portion 102 was 1.9 mm, the length Lt1 of the top-side peripheral portion 124 was 4.8 mm, the length Ls1 of the sole-side peripheral portion 122 was 8.1 mm, and the thickness of the sole outer surface inclined portion 160 was 1.4 mm.

Comparative Example

Figure 6:
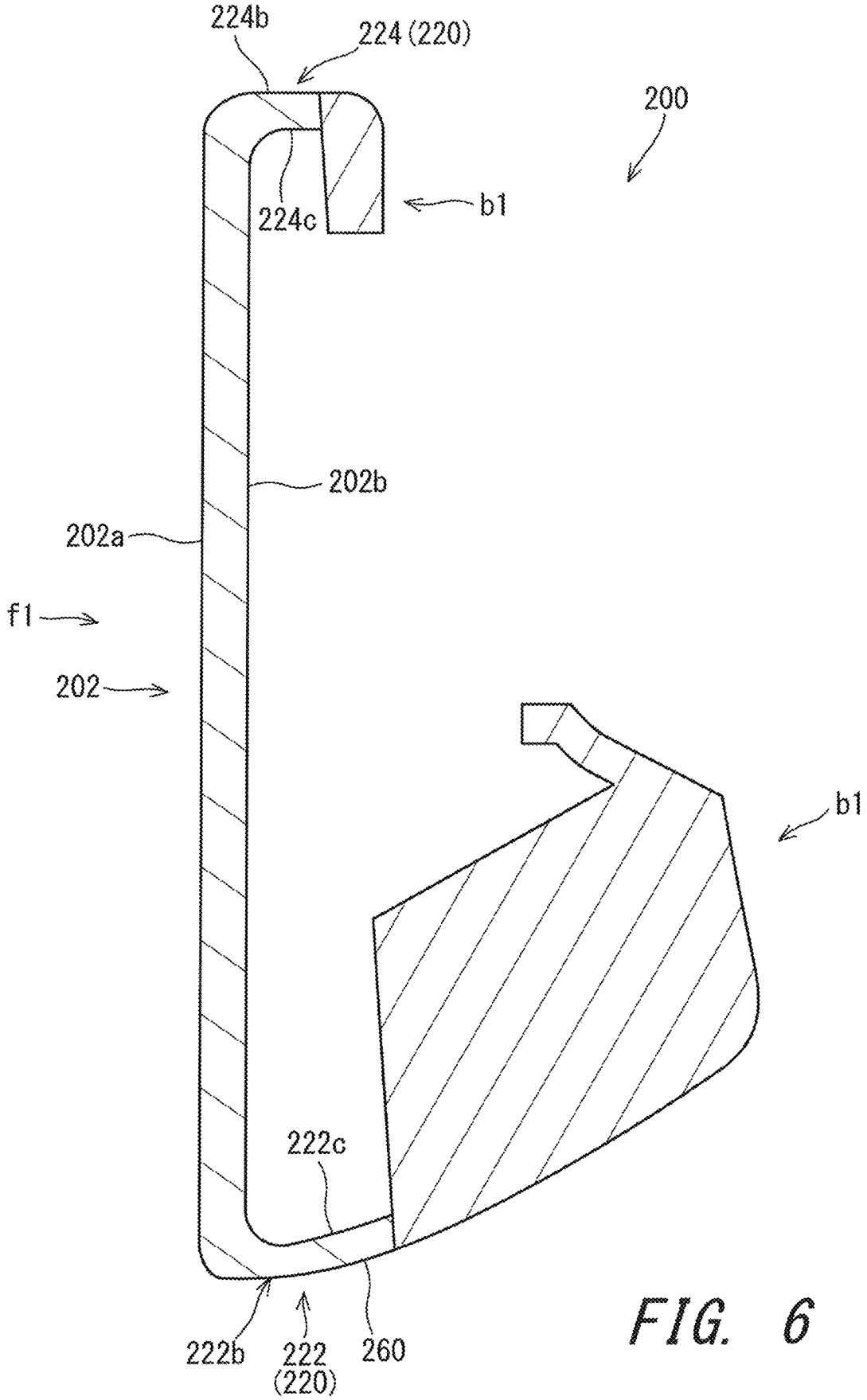
FIG. 6 is a cross-sectional view of a golf club head according to a comparative example.

FIG. 6 is a cross-sectional view of a head 200 according to a Comparative Example. The head 200 includes a body member b1 and a face member f1. The face member f1 includes a face portion 202 and a peripheral portion 220. The face portion 202 includes a hitting face 202*a* and a back surface 202*b*. The peripheral portion 220 includes a sole-side peripheral portion 222 and a top-side peripheral portion 224. The sole-side peripheral portion 222 includes an outer surface 222*b* and an inner surface 222*c*. The top-side peripheral portion 224 includes an outer surface 224*b* and an inner surface 224*c*. The inner surface 224*c* forms an angle of 90 degrees with the hitting face 202*a* and is parallel to the outer surface 224*b*. The outer surface 222*b* includes a sole outer surface inclined portion 260 that extends toward the top direction as it goes toward the back direction. The sole-side peripheral portion 222 has the same shape as the sole-side peripheral portion in the Example.

The thicknesses of the respective portions excluding the top-side peripheral portion 224 were the same as those in the Example. Specifically, the thickness of the face portion 202 was 1.9 mm, the length Lt1 of the top-side peripheral portion 224 was 4.8 mm, the length Ls1 of the sole-side peripheral portion 222 was 8.1 mm, and the thickness of the sole outer surface inclined portion 260 was 1.4 mm.

The face member f1 of this Comparative Example had a shape that cannot be formed by pressing or forging. Accordingly, the face member f1 was formed by casting. A rolled material could not be used as the material of the face member f1. A product obtained by casting has a nonuniform structure, and blowholes (air bubbles) are inevitably formed inside the product. Accordingly, the face member f1 produced by casting has a lower strength than the face member f1 formed of a rolled material. As a result of conducting a durability test, it was found that, in order to allow the face member f1 of the Comparative Example to have a strength equivalent to that of the face member f1 of the Example, it is necessary to set the thickness of the face portion 202 to 2.2 mm.

The head of the Example had an SS-COR of 0.845. The head of the Comparative Example modified such that the face portion 202 had a thickness of 2.2 mm considering the strength had an SS-COR of 0.820. In the Example, the rolling direction was the top-sole direction. Accordingly, in the Example, bending of the face portion increased, resulting in a high SS-COR.

A shaft and a grip were attached to each of the heads of the Example and the Comparative Example to obtain a golf club. A golfer whose official handicap is 10 made trial-hitting using the golf clubs of the Example and the Comparative Example, and made sensory evaluation on a feeling when hitting a ball. The hit feeling of the golf club of the Example was evaluated as providing a sufficient bouncing feeling, whereas the hit feeling of the golf club of the Comparative Example was evaluated as lacking a bouncing feeling. Thus, the golf club of the Example was superior to the golf club of the Comparative Example in the hit feeling.

Regarding the above-described embodiment, the following clauses are disclosed.

[Clause 1]

A golf club head including:

a face member; and a body member joined to the face member, wherein the face member includes a face portion that forms a hitting face, and a peripheral portion that extends toward a back side from a periphery of the face portion, the peripheral portion includes a sole-side peripheral portion that extends toward the back side from the periphery of the face portion on a sole side and a top-side peripheral portion that extends toward the back side from the periphery of the face portion on a top side, the face member is formed of a rolled material, an inner surface of the sole-side peripheral portion includes a sole inner surface inclined portion that extends to reach a back end of the sole-side peripheral portion and that extends toward a top direction as it goes toward a back direction, the inner surface of the sole-side peripheral portion and an inner surface of the top-side peripheral portion are formed in such a manner that, in a cross section perpendicular to a toe-heel direction, a distance between the inner surfaces increases toward the back direction, and an outer surface of the top-side peripheral portion is formed in such a manner that, in the cross section perpendicular to the toe-heel direction, a distance between the outer surface and the inner surface of the top-side peripheral portion increases toward a face direction.

[Clause 2]

The golf club head according to clause 1, wherein an outer surface of the sole-side peripheral portion includes a sole outer surface inclined portion that extends to reach the back end of the sole-side peripheral portion and that extends toward the top direction as it goes toward the back direction, and the outer surface of the top-side peripheral portion and the sole outer surface inclined portion are formed in such a manner that, in the cross section perpendicular to the toe-heel direction, a distance between them decreases toward the back direction.

[Clause 3]

The golf club head according to clause 1 or 2, which is an iron-type golf club head.

[Clause 4]

The golf club head according to any one of clauses 1 to 3, wherein the rolled material is made of an iron-based alloy, a tensile strength of the rolled material is greater than or equal to 1200 MPa, and an average thickness of the face portion is less than or equal to 2.2 mm.

[Clause 5]

The golf club head according to any one of clauses 1 to 3, wherein the rolled material is made of a titanium alloy, a tensile strength of the rolled material is greater than or equal to 800 MPa, and an average thickness of the face portion is less than or equal to 2.5 mm.

[Clause 6]

The golf club head according to any one of clauses 1 to 5, wherein a loft angle is greater than or equal to 20 degrees.

[Clause 7]

The golf club head according to any one of clauses 1 to 6, wherein a length of the sole-side peripheral portion in a face-back direction is greater than a length of the top-side peripheral portion in the face-back direction.

[Clause 8]

The golf club head according to any one of clauses 1 to 7, wherein a COR at a sweet spot is greater than or equal to 0.825.

[Clause 9]

A method for producing a golf club head, the method including the steps of:

forming a face member;

forming a body member; and joining the face member to the body member, the step of forming the face member including:

a step of cutting a rolled material into a predetermined shape corresponding to a shape of the face member; and a face member forming step of forming the face member with a mold from the rolled material that has been cut into the predetermined shape, wherein the face member includes a face portion that forms a hitting face and a peripheral portion that extends toward a back side from a periphery of the face portion, the peripheral portion includes a sole-side peripheral portion that extends toward the back side from the periphery of the face portion on a sole side and a top-side peripheral portion that extends toward the back side from the periphery of the face portion on a top side, an inner surface of the sole-side peripheral portion includes a sole inner surface inclined portion that extends to reach a back end of the sole-side peripheral portion and that extends toward a top direction as it goes toward a back direction, the inner surface of the sole-side peripheral portion and an inner surface of the top-side peripheral portion are formed in such a manner that, in a cross section perpendicular to a toe-heel direction, a distance between the inner surfaces increases toward the back direction, an outer surface of the sole-side peripheral portion includes a sole outer surface inclined portion that extends to reach the back end of the sole-side peripheral portion and that extends toward the top direction as it goes toward the back direction, an outer surface of the top-side peripheral portion and the sole outer surface inclined portion are formed in such a manner that, in the cross section perpendicular to the toe-heel direction, a distance between them decreases toward the back direction, the face member forming step is performed by pressing or forging, the mold includes a male mold and a female mold, and in the face member forming step, the male mold is used to form an inner surface of the face member, and the female mold is used to form an outer surface of the face member.

LIST OF REFERENCE NUMERALS

100 Golf club head
102 Face portion
102*a* Hitting face
102*b* Back surface
104 Sole portion
106 Top surface
108 Hosel
120 Peripheral portion
122 Sole-side peripheral portion
122*b* Outer surface of sole-side peripheral portion
122*c* Inner surface of sole-side peripheral portion
124 Top-side peripheral portion
124*b* Outer surface of top-side peripheral portion
124*c* Inner surface of top-side peripheral portion
150 Sole inner surface inclined portion
160 Sole outer surface inclined portion
f1 Face member
b1 Body member
M11 Male mold
M12 female mold The above descriptions are merely illustrative and various modifications can be made without departing from the principles of the present disclosure.

What is claimed is:

1. A golf club head comprising:

a face member; and a body member joined to the face member, wherein the face member includes a face portion that forms a hitting face, and a peripheral portion that extends toward a back side of the golf club head from a periphery of the face portion, the peripheral portion includes a sole-side peripheral portion that extends toward the back side of the golf club head from the periphery of the face portion on a sole side; and a top-side peripheral portion that extends toward the back side of the golf club head from the periphery of the face portion on a top side, the face member is formed of a rolled material, an inner surface of the sole-side peripheral portion includes a sole inner surface inclined portion that extends to reach a back end of the sole-side peripheral portion and that extends toward a top direction as the sole inner surface inclined portion goes toward a back direction, the inner surface of the sole-side peripheral portion and an inner surface of the top-side peripheral portion are formed such that, in a cross section perpendicular to a toe-heel direction, a first distance between the inner surfaces increases toward the back direction, an outer surface of the top-side peripheral portion is formed such that, in the cross section perpendicular to the toe-heel direction, a second distance between the outer surface and the inner surface of the top-side peripheral portion increases toward a face direction, and in the cross section perpendicular to the toe-heel direction, all points of a back end surface of the top-side peripheral portion and all points of a back end surface of the sole-side peripheral portion are on a same plane.

2. The golf club head according to claim 1, wherein an outer surface of the sole-side peripheral portion includes a sole outer surface inclined portion that extends to reach the back end of the sole-side peripheral portion and that extends toward the top direction as the sole outer surface inclined portion goes toward the back direction, and the outer surface of the top-side peripheral portion and the sole outer surface inclined portion are formed such that, in the cross section perpendicular to the toe-heel direction, a third distance between the outer surface of the top-side peripheral portion and the sole outer surface inclined portion decreases toward the back direction.

3. The golf club head according to claim 1, which is an iron-type golf club head.

4. The golf club head according to claim 1, wherein the rolled material is made of an iron-based alloy, a tensile strength of the rolled material is greater than or equal to 1200 MPa, and an average thickness of the face portion is less than or equal to 2.2 mm.

5. The golf club head according to claim 4, wherein the iron-based alloy is an alloy in which a content of iron is the highest in terms of mass ratio.

6. The golf club head according to claim 1, wherein the rolled material is made of a titanium alloy, a tensile strength of the rolled material is greater than or equal to 800 MPa, and an average thickness of the face portion is less than or equal to 2.5 mm.

7. The golf club head according to claim 1, wherein a loft angle is greater than or equal to 20 degrees.

8. The golf club head according to claim 1, wherein a length of the sole-side peripheral portion in a face-back direction is greater than a length of the top-side peripheral portion in the face-back direction.

9. The golf club head according to claim 8, wherein the length of the sole-side peripheral portion in the face-back direction is greater than or equal to 5 mm and less than or equal to 13 mm, and the length of the top-side peripheral portion in the face-back direction is greater than or equal to 3 mm and less than or equal to 11 mm.

10. The golf club head according to claim 1, wherein a coefficient of restitution (COR) at a sweet spot is greater than or equal to 0.825.

11. The golf club head according to claim 1, wherein a length of the sole-side peripheral portion in a face-back direction is greater than or equal to 5 mm and less than or equal to 13 mm.

12. The golf club head according to claim 1, wherein a length of the top-side peripheral portion in a face-back direction is greater than or equal to 3 mm and less than or equal to 11 mm.

13. The golf club head according to claim 1, wherein, in the cross section perpendicular to the toe-heel direction, the outer surface of the top-side peripheral portion includes a straight portion from the back end surface of the top-side peripheral portion to a plane extending through a back surface of the face member, and an angle formed by the straight portion of the outer surface of the top-side peripheral portion and the hitting face is greater than or equal to 85° and less than or equal to 95°.

14. The golf club head according to claim 1, wherein the same plane at which said all points of the back end surface of the top-side peripheral portion and said all points of the back end surface of the sole-side peripheral portion are on is inclined with respect to a back surface of the face member.

15. The golf club head according to claim 1, wherein the second distance increases continuously toward the face direction.

16. The golf club head according to claim 1, wherein the face member has a front side and a back side opposite the front side, and the body member is fixedly coupled to the back side of the face member.

17. A method for producing a golf club head, the method comprising:

forming a face member having a front side and a back side opposite the front side;

forming a body member; and joining the back side of the face member to the body member, said forming the face member including:

cutting a rolled material into a predetermined shape corresponding to a shape of the face member; and forming the face member with a mold from the rolled material that has been cut into the predetermined shape, wherein the face member includes a face portion that forms a hitting face and a peripheral portion that extends toward a back side of the golf club head from a periphery of the face portion, the peripheral portion includes: a sole-side peripheral portion that extends toward the back side of the golf club head from the periphery of the face portion on a sole side; and a top-side peripheral portion that extends toward the back side of the golf club head from the periphery of the face portion on a top side, an inner surface of the sole-side peripheral portion includes a sole inner surface inclined portion that extends to reach a back end of the sole-side peripheral portion and that extends toward a top direction as the sole inner surface inclined portion goes toward a back direction, the inner surface of the sole-side peripheral portion and an inner surface of the top-side peripheral portion are formed such that, in a cross section perpendicular to a toe-heel direction, a first distance between the inner surfaces increases toward the back direction, an outer surface of the sole-side peripheral portion includes a sole outer surface inclined portion that extends to reach the back end of the sole-side peripheral portion and that extends toward the top direction as the sole outer surface inclined portion goes toward the back direction, an outer surface of the top-side peripheral portion and the sole outer surface inclined portion are formed such that, in the cross section perpendicular to the toe-heel direction, a second distance between the outer surface of the top-side peripheral portion and the sole outer surface inclined portion decreases toward the back direction, said forming the face member is performed by pressing or forging, the mold includes a male mold and a female mold, for said face member forming, the male mold is used to form an inner surface of the face member, and the female mold is used to form an outer surface of the face member, said joining includes welding a back end surface of the top-side peripheral portion to a top-side portion of the body member, and in the cross section perpendicular to the toe-heel direction, all points of the back end surface of the top-side peripheral portion and all points of a back end surface of the sole-side peripheral portion are on a same plane.

18. The method according to claim 17, further comprising adjusting a thickness distribution of the rolled material by numerical control (NC) processing, said thickness adjusting being performed prior to said forming the face member.

19. A golf club head comprising:

a face member having a front side and a back side opposite the front side; and a body member welded to the back side of the face member, wherein the face member includes a face portion that forms a hitting face, and a peripheral portion that extends toward a back side of the golf club head from a periphery of the face portion, the peripheral portion includes a sole-side peripheral portion that extends toward the back side from of the golf club head the periphery of the face portion on a sole side; and a top-side peripheral portion that extends toward the back side of the golf club head from the periphery of the face portion on a top side, an inner surface of the sole-side peripheral portion includes a sole inner surface inclined portion that extends to reach a back end of the sole-side peripheral portion and that extends toward a top direction as the sole inner surface inclined portion goes toward a back direction, the inner surface of the sole-side peripheral portion and an inner surface of the top-side peripheral portion are formed such that, in a cross section perpendicular to a toe-heel direction, a first distance between the inner surfaces increases toward the back direction, an outer surface of the top-side peripheral portion is formed such that, in the cross section perpendicular to the toe-heel direction, a second distance between the outer surface and the inner surface of the top-side peripheral portion increases toward a face direction, a back end surface of the top-side peripheral portion is welded to a top-side portion of the body member, and in the cross section perpendicular to the toe-heel direction, all points of the back end surface of the top-side peripheral portion and all points of a back end surface of the sole-side peripheral portion are on a same plane.

20. The golf club head according to claim 19, wherein the second distance increases continuously toward the face direction, and in the cross section perpendicular to the toe-heel direction, the face portion is parallel to a back surface of the face member.

* * * * *